US008779259B1

(12) United States Patent
Herrmann

(10) Patent No.: US 8,779,259 B1
(45) Date of Patent: Jul. 15, 2014

(54) FRICTION REDUCTION IN AN ELECTRIC GUITAR

(71) Applicant: Mark V. Herrmann, Reno, NV (US)

(72) Inventor: Mark V. Herrmann, Reno, NV (US)

( * ) Notice: Subject to any disclaimer, the term of this patent is extended or adjusted under 35 U.S.C. 154(b) by 0 days.

(21) Appl. No.: 13/751,425

(22) Filed: Jan. 28, 2013

(51) Int. Cl.
*G10D 3/00* (2006.01)
*G10D 1/08* (2006.01)
*G10D 3/14* (2006.01)

(52) U.S. Cl.
CPC . *G10D 3/146* (2013.01); *G10D 1/08* (2013.01)
USPC ..... 84/313

(58) Field of Classification Search
CPC ..... G10D 3/146
USPC ..... 84/313
See application file for complete search history.

(56) References Cited

U.S. PATENT DOCUMENTS

| | | | | | |
|---|---|---|---|---|---|
| 2,191,776 | A | * | 2/1940 | Schreiber | 84/314 N |
| 2,905,042 | A | | 9/1959 | Hoyer | |
| 2,972,923 | A | * | 2/1961 | Fender | 84/313 |
| 3,237,502 | A | | 3/1966 | Moseley | |
| 3,326,072 | A | | 6/1967 | Price | |
| 3,411,394 | A | * | 11/1968 | Jones | 84/313 |
| 3,500,711 | A | | 3/1970 | Fender | |
| 4,304,163 | A | | 12/1981 | Siminoff | |
| 4,385,543 | A | | 5/1983 | Shaw | |
| 4,457,201 | A | * | 7/1984 | Storey | 84/313 |
| D280,522 | S | | 9/1985 | Page | |
| 4,709,612 | A | * | 12/1987 | Wilkinson | 84/314 N |
| 4,903,568 | A | | 2/1990 | Itoh | |
| 5,173,565 | A | | 12/1992 | Gunn | |
| 5,260,504 | A | | 11/1993 | Turner | |
| 5,438,901 | A | * | 8/1995 | Sperzel | 84/297 R |
| 5,492,044 | A | * | 2/1996 | Sperzel | 84/297 R |
| 5,637,817 | A | * | 6/1997 | Sherman | 84/313 |
| 5,696,336 | A | * | 12/1997 | Sperzel | 84/314 N |
| 5,747,713 | A | * | 5/1998 | Clement | 84/313 |
| RE36,484 | E | | 1/2000 | Turner | |
| 6,124,536 | A | * | 9/2000 | Hoshino | 84/298 |
| 6,166,309 | A | * | 12/2000 | Hoshino | 84/298 |
| 6,465,722 | B2 | | 10/2002 | Powers | |
| 6,806,411 | B1 | | 10/2004 | Allen | |
| 7,164,073 | B2 | * | 1/2007 | Sperzel | 84/297 R |
| 7,259,309 | B1 | * | 8/2007 | Lovelace et al. | 84/313 |
| 7,488,878 | B2 | | 2/2009 | LaMarra | |
| 7,863,508 | B2 | | 1/2011 | Bishop | |
| 8,110,729 | B2 | | 2/2012 | Guthrie | |
| 2012/0137851 | A1 | | 6/2012 | van Ekstrom | |

FOREIGN PATENT DOCUMENTS

| | | | |
|---|---|---|---|
| WO | 9633485 | A1 | 10/1996 |

* cited by examiner

*Primary Examiner* — Robert W Horn
(74) *Attorney, Agent, or Firm* — William H. Eilberg

(57) ABSTRACT

A reduced-friction pad is positioned between a tremolo and a guitar body. The pad substantially prevents direct contact between the tremolo and the guitar body, and reduces friction produced when the tremolo is pivoted or moved. The result is a tremolo which more reliably returns to its original position. The guitar also includes a roller block for accommodating a guitar string. The block includes a chamber which houses at least one low-friction shim, and a low-friction roller, the shim and roller being held within the chamber by a snap spring. The roller block can be implemented at either or both ends of the guitar, and can also be installed on a tremolo. The roller block reduces friction on the string, and enables the guitar to be more reliably tuned.

20 Claims, 9 Drawing Sheets

FRICTION REDUCTION IN AN ELECTRIC GUITAR

BACKGROUND OF THE INVENTION

The present invention relates to electric guitars, and provides means for reducing friction in various components of the guitar.

Many electric guitars are equipped with a tremolo device, also known simply as a tremolo. The purpose of the tremolo is to allow the player to vary the tension in the strings, thereby momentarily changing the pitch of the sounds produced.

There are various kinds of tremolos, having differing structures. The present invention is most relevant to a Fender-style or vintage tremolo, but may be applicable to other tremolos, depending on their structures.

The tremolo, which is located at the bridge of the guitar, or which itself serves as the bridge of the guitar, comprises a tremolo block to which the strings are attached. The strings, once in tune, are in tension, and provide a force of about 17 pounds per string, for a total force on the tremolo, of 102 pounds, for a six-stringed instrument. To balance the force of the strings, the tremolo includes springs which are attached to the tremolo block and provide a force of about 102 pounds in the opposite direction. Thus, the tremolo is manipulated as a lever, against the force exerted by the strings.

The tremolo is controlled by a bar or lever, called a tremolo arm, which is capable of pivoting or moving the tremolo slightly, thereby altering the tension in the strings, and changing the pitch of the sounds made by the strings.

A problem with a tremolo is that when the device is pivoted, it does not always return to its exact original position. Although the purpose of the tremolo is to change the tuning of the strings, it is usually desired to return the strings to their original, tuned condition. In the tremolos of the prior art, this goal is often not achieved. The guitar must therefore be re-tuned, which is impractical to do while playing.

A temporary solution to the problem is to adjust the tremolo arm, to attempt to re-tune while playing. But this approach is clearly unreliable. For this reason, some players choose not to use the tremolo at all.

The above-described problem is believed to result from friction between the tremolo and the body of the guitar. As the tremolo is pivoted, it rubs against the guitar body, in a manner which cannot be predicted with precision. This is why the tremolo is unlikely to return to its exact original position.

A similar problem, due to friction, occurs near the opposite end of the string, i.e. at the nut of the guitar. The nut is the device located at the junction of the headstock and the fretboard. The strings pass over the nut, and, when tuned, are in tension as described above. In some cases, the nut may be "sticky" with respect to the guitar string, so that the string does not move smoothly across the nut. In other cases, the string will slide across the nut. When one tunes the guitar, the string is vibrating between the nut and the bridge. But because of the varying friction between the string and the nut, the string can go out of tune unpredictably. As the guitar is played, the string moves, causing the tension between the bridge and the nut, and between the nut and the tuning peg, to equalize or de-equalize. The insertion of a random and variable amount of friction, at the position of the nut, makes it more likely that the string will go out of tune.

One system of the prior art, designed for keeping an electric guitar in tune, is a Floyd Rose double-locking tremolo. Once the musician has tuned the guitar, the Floyd Rose system locks the guitar strings down at both the nut and the bridge. One is still able to make minor tuning adjustments at the bridge, but the result is a guitar that stays in tune longer. The disadvantage of this system is that when the guitar goes out of tune, the musician must unlock the strings at the nut and re-tune and re-lock. The above-described system is also expensive, requiring some machining work to set it up on the guitar.

The present invention provides improvements in electric guitars, to solve the problems described above. In particular, the present invention includes a low-friction pad, for use with a tremolo, which pad substantially reduces the friction between the tremolo and the guitar body. The invention also includes a reduced-friction roller nut which serves to equalize the tension in the various portions of the string. The structure of the reduced-friction roller nut may also be advantageously provided at other locations on the guitar, and not just at the nut. These improvements, which are described in detail below, can be used in combination or individually.

SUMMARY OF THE INVENTION

The present invention comprises improvements in electric guitars, the improvements being intended to reduce friction in various components.

In one embodiment, applicable to a guitar having a tremolo, the invention comprises a tremolo pad positioned between the tremolo and the body of the guitar. The tremolo pad is a thin sheet of low-friction material. The tremolo pad preferably extends beyond the "footprint" of the tremolo, and thereby comprises a buffer between the tremolo and the guitar body. The tremolo pad therefore has an area which is sufficiently large to prevent the tremolo from making any significant direct contact with the guitar body. The tremolo pad reduces friction generated when the tremolo is moved or pivoted, and makes it easier to return the tremolo to its original position after it has been moved.

In another embodiment, the invention comprises a roller block for accommodating a guitar string. The roller block includes a chamber within which there is at least one shim and a roller. A pair of snap springs hold the roller and shim(s) within the chamber. The chamber defines a space through which a guitar string extends. The shim which contacts the roller has a surface of reduced friction. There may be additional shims, out of contact with the roller, in the chamber, the number of shims being selected so as to control the position of the string.

The roller block may have a single chamber, or it may include a unitary structure defining multiple chambers, all having the features described above.

The roller block can be used at various locations on the guitar. For example, the roller block can serve as the nut of the guitar, located between the headstock and the fretboard. But the roller block structure can also be used at the bridge end of the guitar. A tremolo can be provided with the above-described roller block structure. Alternatively, a guitar without a tremolo can use the roller block structure, at the bridge end of the guitar.

The various features of the invention can be used alone or in any combination. Thus, the guitar of the present invention can have a tremolo and tremolo pad, with or without the roller block structures, which in turn may be positioned near the nut and/or on the tremolo. The present invention can work with a guitar having no tremolo, in which case it can be provided with a roller block structure, at either or both ends of the guitar.

The present invention therefore has a primary object of reducing friction in various components of a guitar.

The invention has the further object of reducing friction between a tremolo and a guitar body, thereby improving the reliability of the tremolo.

The invention has the further object of reducing friction in the structures which guide the strings of a guitar, thereby making it easier to keep a guitar in tune.

The invention has the further object of providing a friction reduction block for guiding guitar strings, wherein said block can be used near either or both ends of a guitar.

The reader skilled in the art will recognize other objects and advantages of the present invention, from a reading of the following brief description of the drawings, the detailed description of the invention, and the appended claims.

DETAILED DESCRIPTION OF THE INVENTION

Figure 1:
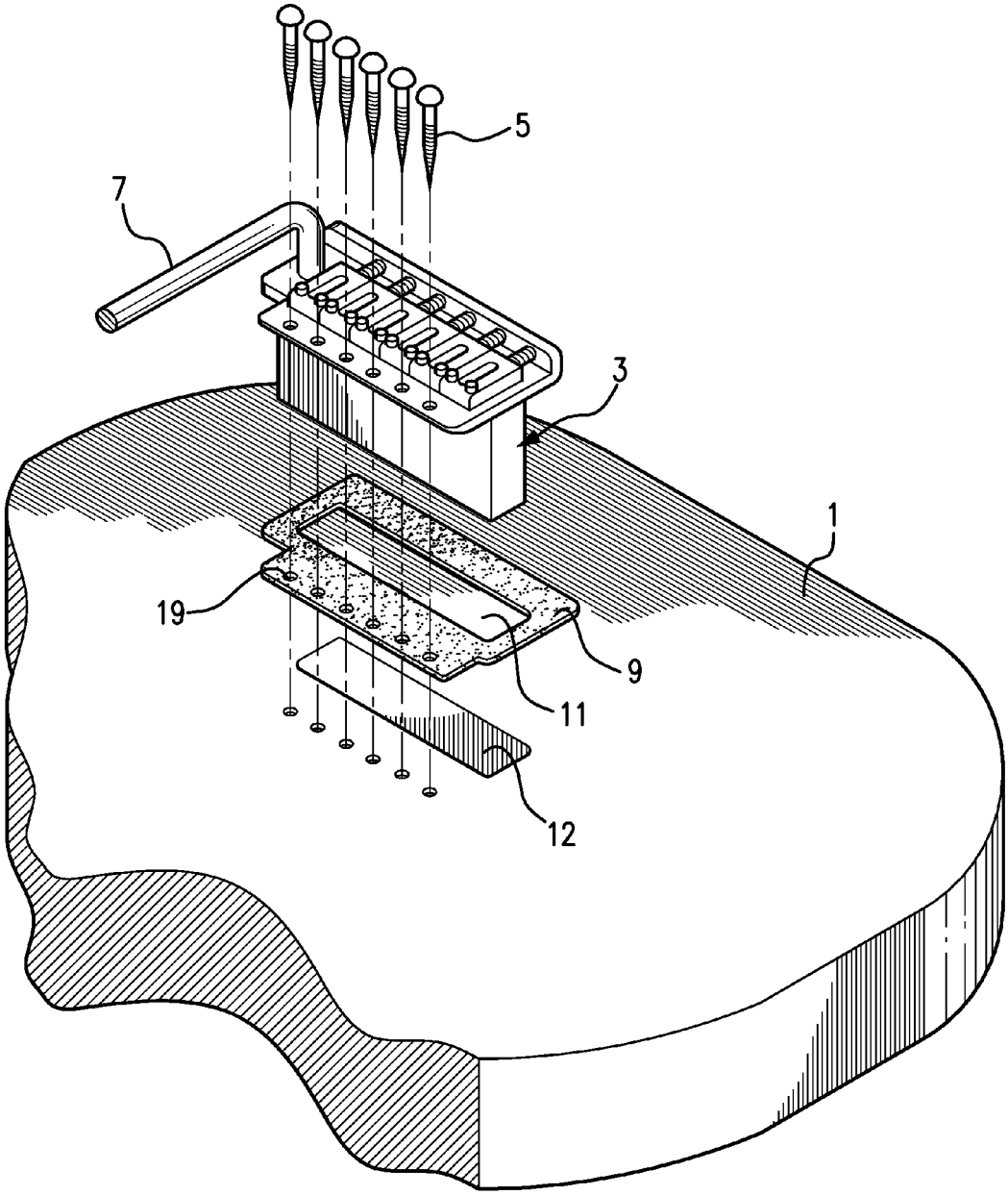
FIG. 1 provides a fragmentary, exploded perspective view of a guitar having a tremolo device, the device including a low-friction tremolo pad according to the present invention.
Figure 2:
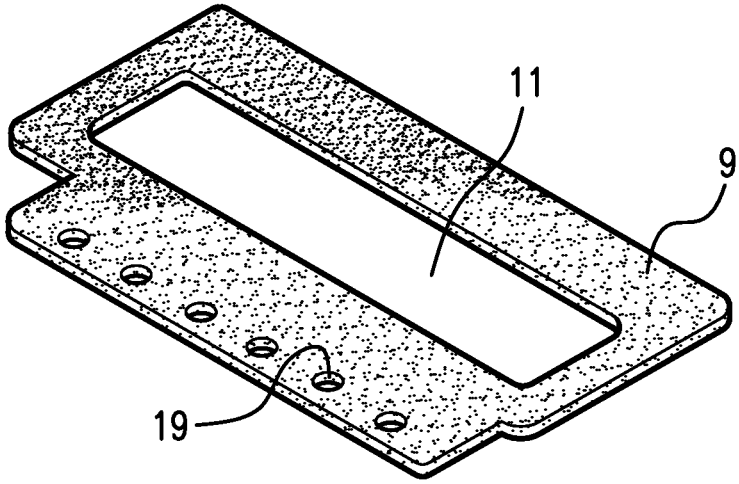
FIG. 2 provides a perspective view of the low-friction pad used with a tremolo device, according to the present invention.
Figure 3:
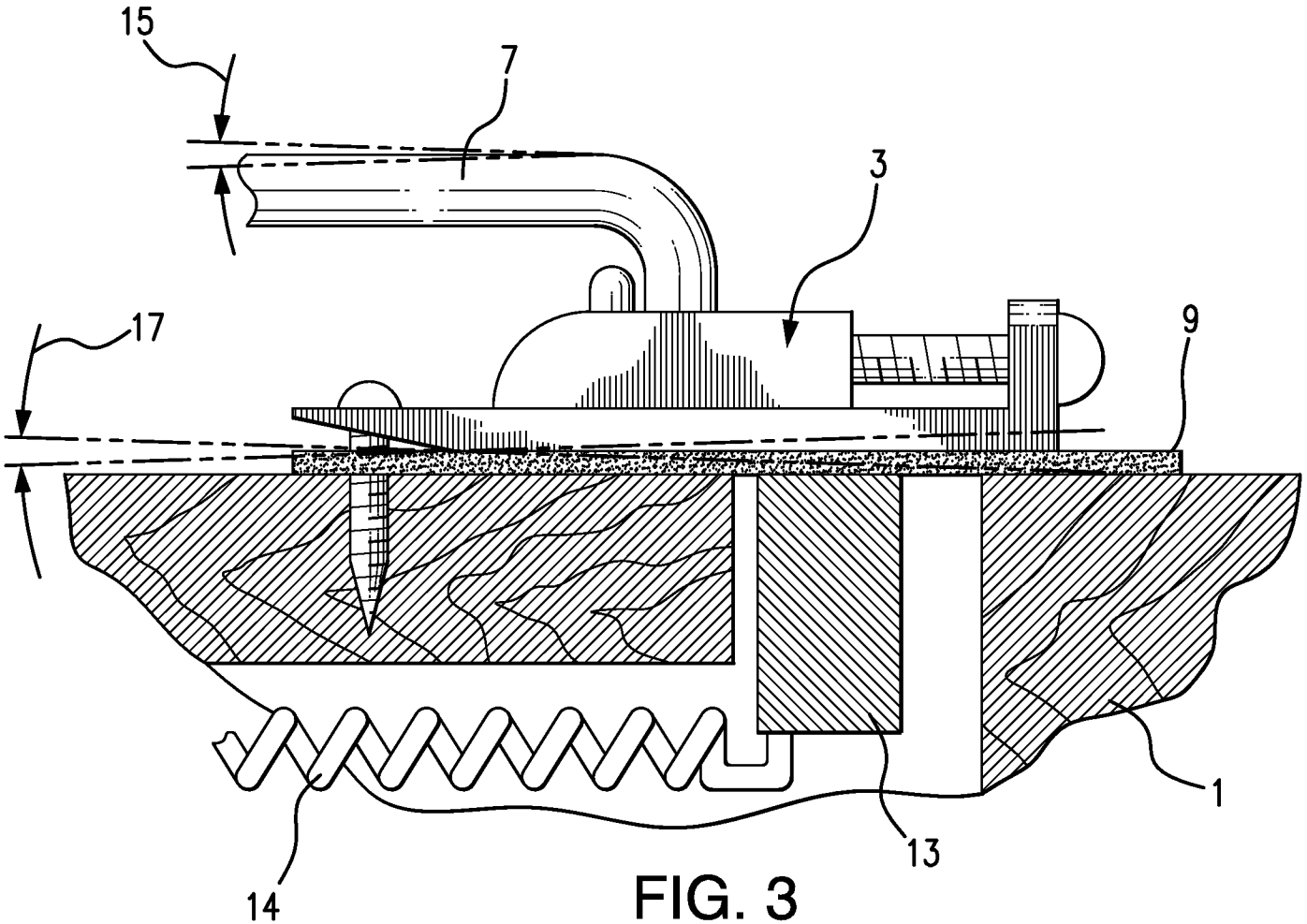
FIG. 3 provides a cross-sectional view of the tremolo device, inserted into the body of a guitar, and showing the low-friction pad made according to the present invention.

FIGS. 1-3 illustrate a first embodiment of the present invention, comprising reduction of friction in a tremolo. Guitar 1 includes tremolo 3, the tremolo being secured to the guitar body by screws 5. The tremolo 3 includes tremolo arm 7 which controls the tremolo by pivoting, or otherwise moving, the tremolo so as to vary the tension in the strings (not shown).

A distinguishing feature of the present invention is tremolo pad 9, which is a thin sheet of low-friction material. The tremolo pad is positioned between the tremolo and the body of the guitar. The tremolo pad 9 is shown in isolation in the perspective view of FIG. 2. As is best shown in FIGS. 1 and 2, the tremolo pad 9 includes a cut-out portion 11 to accommodate the portion 13 of the tremolo which sits below the surface of the guitar (see FIG. 3). This sub-surface portion 13 extends through opening 12 in the surface of the guitar. The tremolo pad also includes holes 19 which accommodate the screws 5.

As illustrated in FIGS. 1 and 3, the tremolo pad 9 has an area sufficient to correspond to the "footprint" of the tremolo, and to extend somewhat beyond that footprint. Thus, the tremolo pad 9 substantially prevents direct contact between the tremolo and the surface of the body of the guitar. Making the pad extend beyond the footprint of the tremolo enables the device to accommodate variations in the sizes of tremolos of various manufacturers. Also, the pad extends beyond the back side of the tremolo to accommodate the hole in the guitar, through which the tremolo block extends.

Thus, the area of the tremolo pad is sufficiently large at least to provide a buffer between the tremolo and the guitar body.

The thickness of the tremolo pad may be in the range of about 0.005 to 0.030 inches, with a preferred thickness being about 0.020 inches. The invention should not be deemed limited to these particular values, however, and the pad could have a thickness outside of the above-mentioned range.

FIG. 3 shows the pivoting motion of the tremolo 3, due to movement of the tremolo arm 7. When the tremolo arm is pivoted as indicated by arrows 15, the tremolo pivots correspondingly as shown by arrows 17. A spring 14 tends to bring the tremolo arm back to its original position. The spring is connected to a suitable fastener or other connection device (not shown), inside the guitar body. Even a very slight pivoting movement is enough to vary the tension in the strings, and the result can be a dramatic change in pitch of the sounds produced by the guitar 1.

The low-friction material used to make the tremolo pad 9 can be poly tetrafluoroethylene (PTFE), also known as Teflon. Alternatively, one could use glass-filled PTFE, bronze-filled PTFE, nickel-filled PTFE, carbon-filled PTFE, reinforced PTFE, modified PTFE, PTFE-filled resins, PTFE-filled plastics. In general, the material could be PTFE and composite materials containing PTFE.

In addition, one could use composite materials containing carbon or graphite, or composite materials containing nylon.

Furthermore, one could start with a material which itself is not a low-friction material, and coat the material with a low-friction material such as PTFE, carbon, and others. That is, one can provide a material having only a low-friction surface.

The tremolo pad 9 is such that it is interposed between the tremolo and the surface of the body of the guitar, at virtually all locations at which the tremolo would otherwise touch the body. Thus, when the tremolo is pivoted by the tremolo arm 7, the tremolo does not rub against the guitar body, but instead rubs only against the low-friction sheet. The result is a tremolo which tends to return reliably to its original position after use.

Another embodiment of the invention comprises a reduced friction roller block for a guitar. The reduced friction roller block, and its associated components, are shown in FIGS. 4-6*b*. In the embodiment shown in FIG. 4, the roller block replaces the nut of the guitar, the nut being located at the junction of the headstock 24 and the fretboard 26. As will be seen below, the concept of the roller block can be used at other locations on the guitar, and not solely at the nut.

A roller block 23 defines a plurality of chambers 25 for housing the components which engage each string. Each chamber includes a shim 27, a low-friction shim 29, a roller 31, and a pair of snap springs 33. The snap springs 33, when assembled, engage the roller block 23 through holes 35. The chamber defines a space 44 within which a string can be seated, and through which the string extends.

Figure 4:
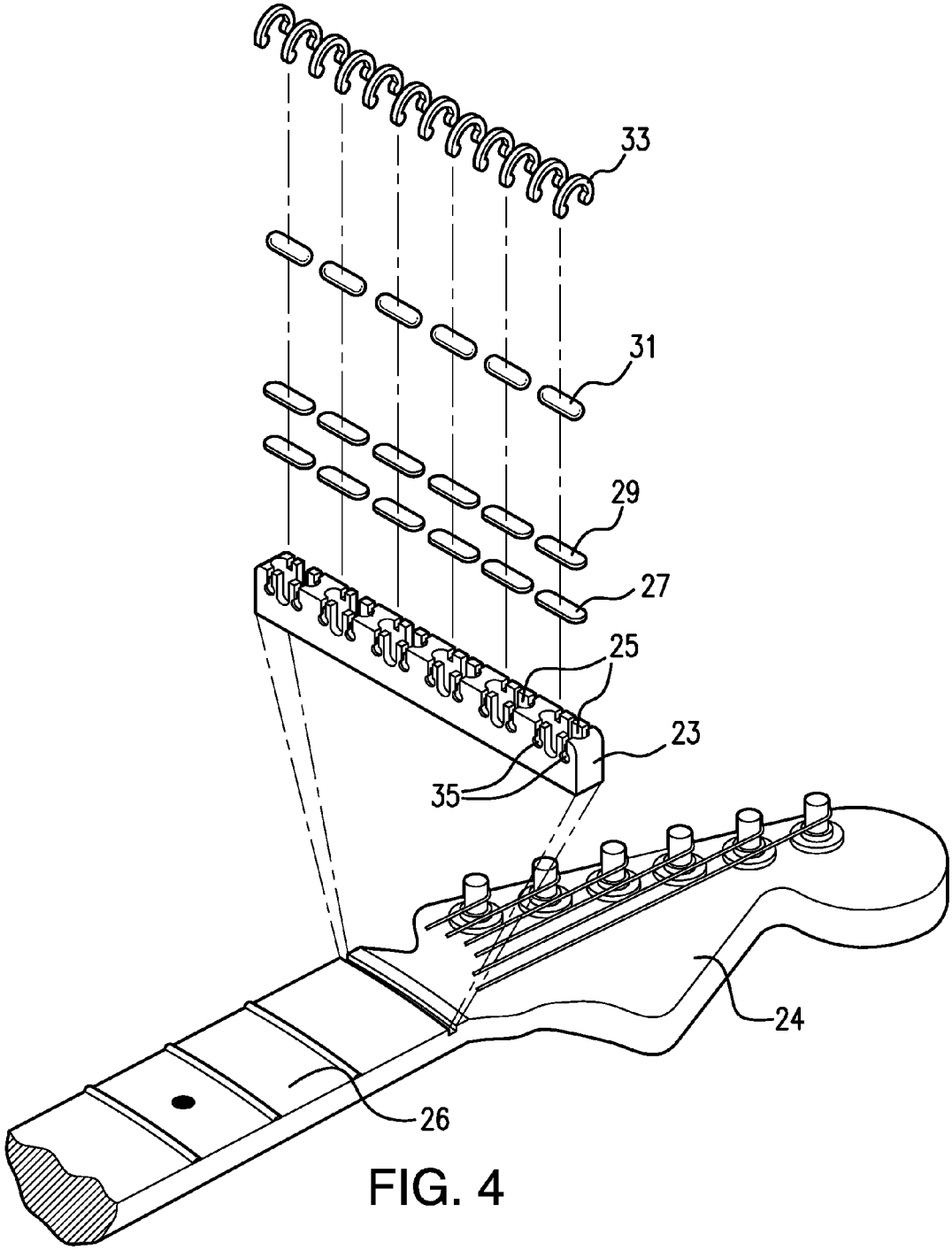
FIG. 4 provides a fragmentary, exploded perspective view of a nut of a guitar, in which the nut is equipped with reduced-friction rollers according to the present invention.
Figure 5:
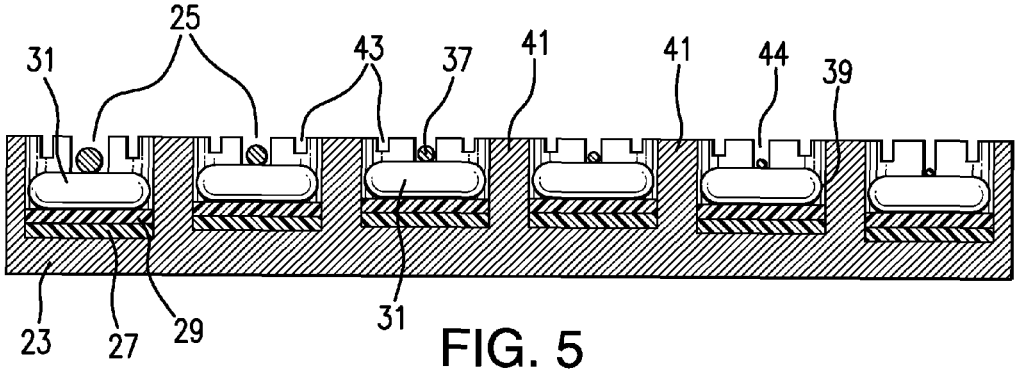
FIG. 5 provides an elevational view, in cross-section, showing the roller block of the present invention.
Figure 6:
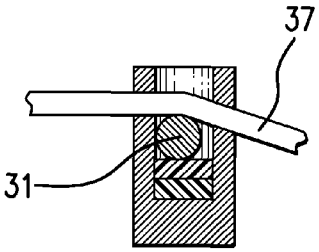
FIG. 6 provides a cross-sectional view of a portion of a roller block of the present invention, and showing the relationship between a guitar string and the other components of the roller block.
Figure 6A:
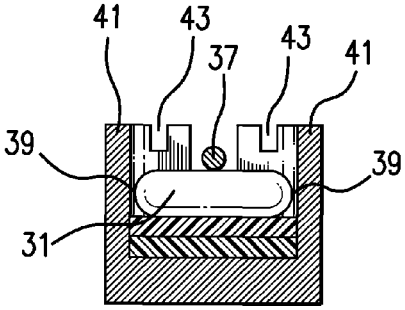
FIG. 6*a* provides a cross-sectional view showing a single chamber accommodating a single guitar string, according to the present invention.
Figure 6B:
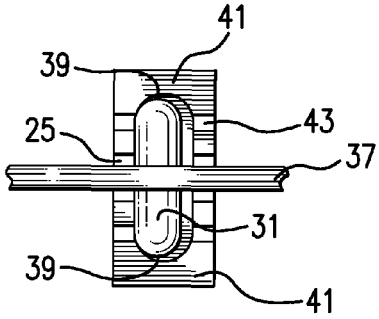
FIG. 6*b* provides a top view of the chamber shown in FIG. 6*a*, the view of FIG. 6*b* being rotated by 90° relative to that of FIG. 6*a*.

FIGS. 5, 6, and 6*a* provide cross-sectional views showing the components of FIG. 4 (except for the snap springs) in the assembled condition. FIG. 6*b* shows a top view. The top view of 6*b* is rotated by 90° relative to the view of FIG. 6*a*. FIGS. 5-6*b* also show guitar strings 37.

FIG. 5 shows a roller block, defining six chambers 25, for six strings 37. That is, FIG. 5 shows a unitary block in which the chambers are formed.

FIG. 6 shows a side view, in cross-section, of a single chamber, with a string 37 extending over the roller 31.

FIG. 6*a* provides a view similar to that of FIG. 5, but showing only a single chamber. The number of chambers can be varied if the instrument has more or fewer than six strings.

The top view of FIG. 6*b* shows that the walls 41 defining the chamber are curved, with a radius of curvature somewhat greater than that of the rounded ends 39 of the roller 31. Thus, the roller 31 sits within a chamber having a shape which is similar to that of the roller, except that the volume of the chamber is larger than that of the roller. The radius of curvature of the wall is only slightly larger than that of the rounded end of the roller; the effect is somewhat exaggerated in the view of FIG. 6*b*, for purposes of illustration.

As can be seen from the figures, the shims 27 enable adjustment of the vertical position of the rollers and strings. Although the figures show only one shim 27 in each chamber, in the more general case, there can be two or more such shims. Furthermore, the number of shims 27 in a chamber could be zero, if only one shim thickness is needed. In the latter case, one can rely only on the low-friction shim 29.

Moreover, the number of shims in one chamber could be different from that in another chamber. The shims 27, which do not touch the rollers 31, need not be made of a low-friction material.

The thickness of the shims may be in the range of between 0.005 to 0.060 inches. However, the invention should not be deemed limited by the above value.

In a preferred embodiment, an assortment of shims can be provided, having a variety of thicknesses, to allow the user to build up a shim having any desired effective thickness. For example, a set of shims could be provided having thicknesses or heights (in inches) of 0.010, 0.020, 0.030, and 0.040. A user could, for example, combine a low-friction shim having a thickness of 0.020 inches, with a regular shim having a thickness of 0.030, to yield a shim with an effective thickness of 0.050 inches. The low-friction shim would preferably be provided in only one thickness, because only the shim that is in contact with the roller needs to have low friction.

The diameter of the roller may be in the range of about 0.040 to 0.075 inches, with a preferred value being about 0.0575 inches. But the invention should not be deemed limited to these particular values.

Low-friction shims 29 are preferably made of any of the low-friction materials discussed above. As explained above, it is not necessary that the entire shim 29 be formed of a low-friction material. It is possible, instead, to provide a low-friction coating on the surface of the shim, where the body of the shim itself has higher friction.

The rollers 31 are of generally cylindrical shape, except that their ends 39 are rounded, as shown in the figures. The rollers are preferably made of metal, such as stainless steel, and are polished. The polishing helps to reduce friction, although the roller itself is not made of a low-friction material.

Rounding of the ends of the rollers further reduces friction between the rollers 31 and the walls 41 defining each chamber. But the primary purpose of the rounded ends is to enable the roller to fit properly within the chamber, and thus to center the roller in the chamber. The rollers 31 are generally free to rotate about their longitudinal axis, with minimal frictional resistance, due to the fact that each roller contacts a low-friction shim 29, and also due to the rounded end 39 which contacts the wall 41 essentially at only one point.

Grooves 43 facilitate the insertion of snap springs 33 (shown in FIG. 4). The snap springs are designed such that their resting diameter is somewhat less than the inside dimension of the object being grasped, which is the outside wall of the block which defines the chamber. During insertion, the springs are stretched slightly, and the ends of the springs therefore resiliently engage the holes 35 in the block. The springs hold the rollers and shims securely within the chamber.

Guitar strings 37 are stretched over the rollers 31. As the string is tightened, it may move longitudinally, and as it so moves, it may cause the adjacent roller 31 also to move. In this way, the string is effectively tuned between the bridge and the tuning pegs, and is not artificially blocked at the nut. Instead, the friction between the string and the nut is minimized, and the positioning of the strings with respect to the nut is made more uniform and predictable.

Figure 7:
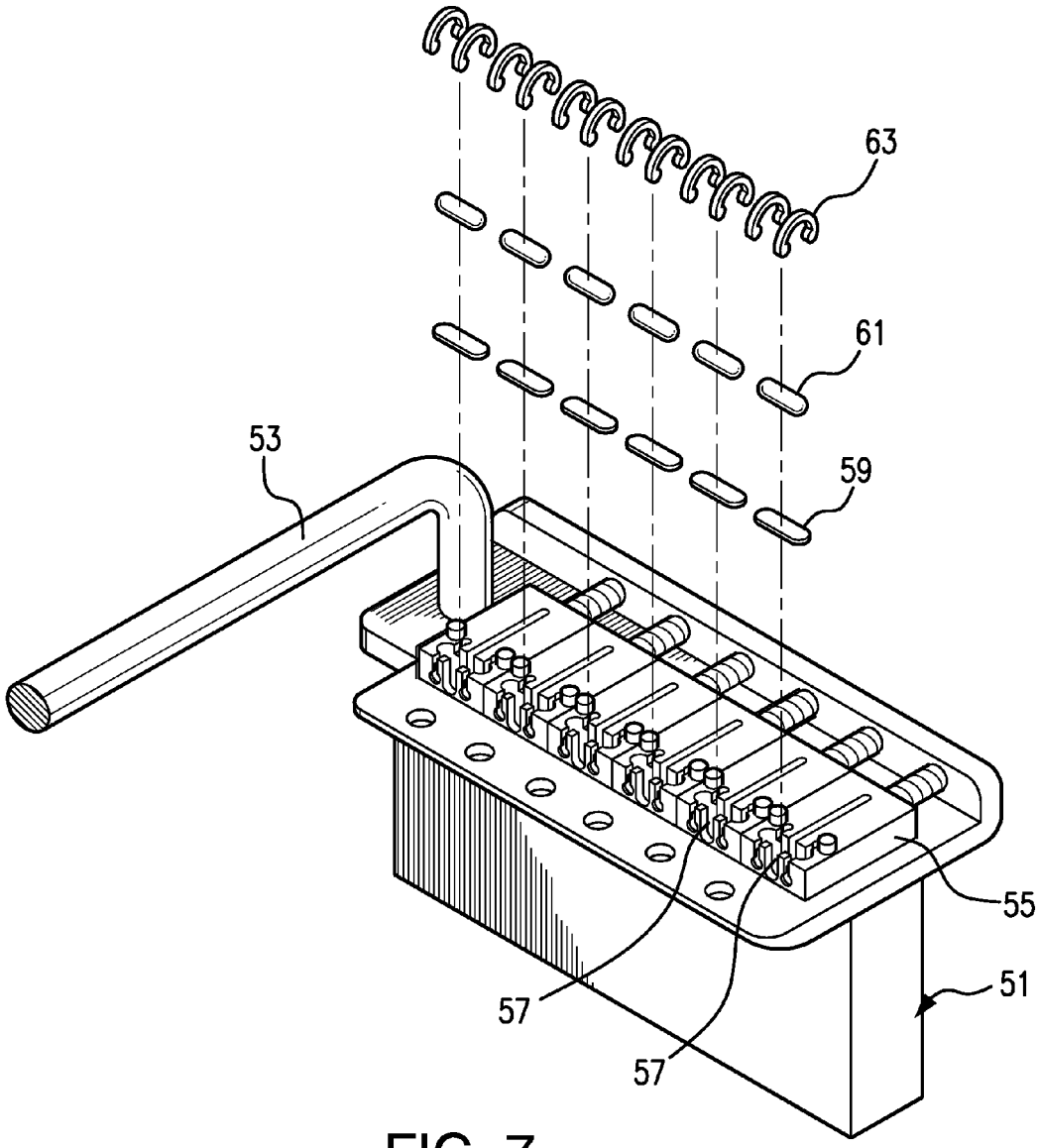
FIG. 7 provides a perspective view of a tremolo which has been equipped with rollers, according to the present invention.

FIG. 7 shows another embodiment of the present invention. In this embodiment, the roller block structure of FIGS. 4-6*b* is incorporated into a tremolo. In particular, tremolo 51, having tremolo arm 53, includes block or blocks 55 defining a plurality of chambers 57. In the example of FIG. 7, there are again six chambers, for the case of a six-string guitar. For each chamber, there is a shim 59, a roller 61, and a pair of snap springs 63. FIG. 7 shows only one shim for each chamber, but it should be understood that there could be two or more regular shims, and a low-friction shim engaging the roller, just as in the embodiment previously described.

Thus, the roller block structure for engaging the strings, described with respect to FIGS. 4-6*b*, can be used at either or both ends of the guitar.

Moreover, the tremolo pad, though it is not shown in FIG. 7, could be used in this embodiment. Thus, the tremolo pad and the roller block structure could be used at the same end of the guitar. The roller block is thus not limited to the region of the headstock.

Figure 8:
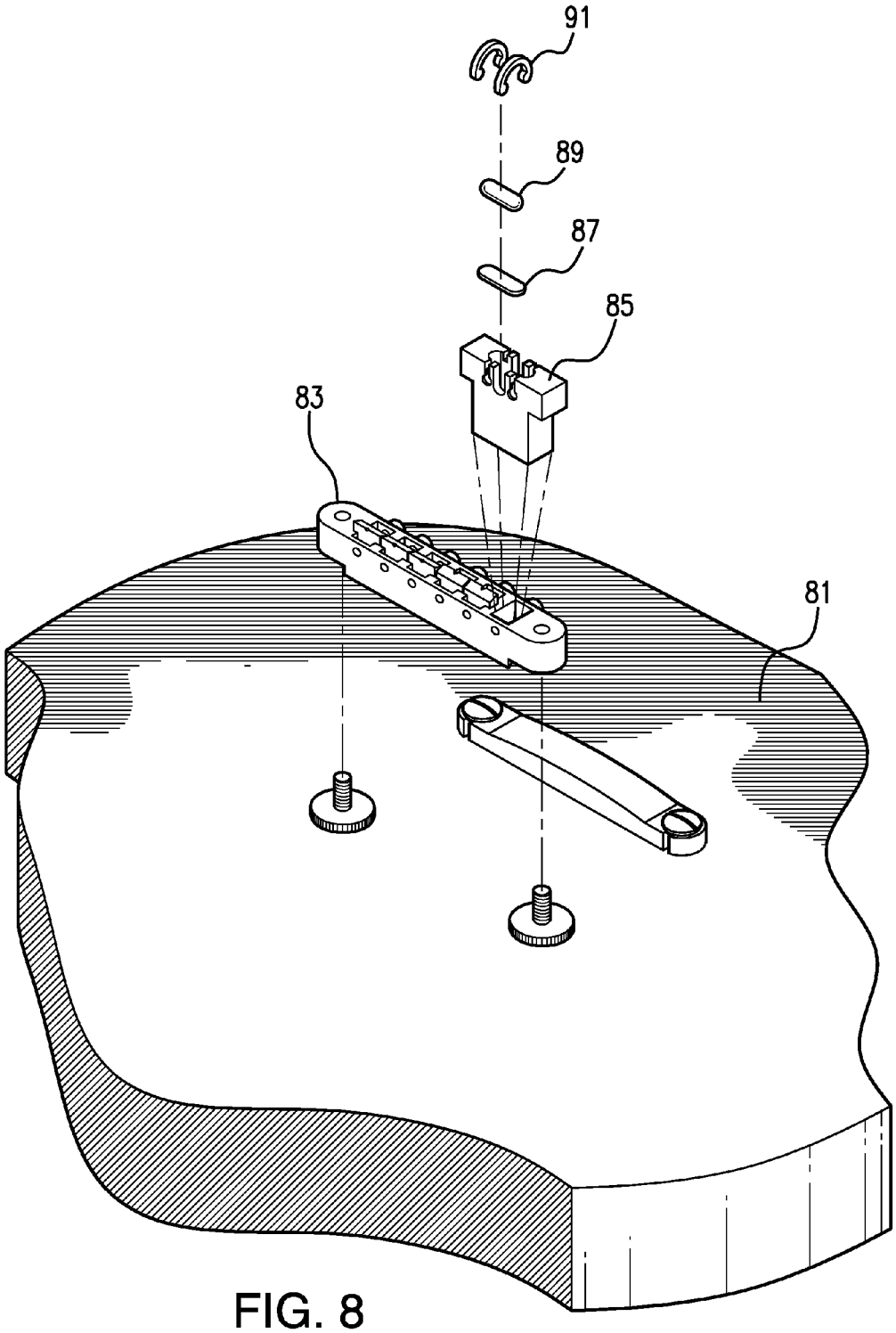
FIG. 8 provides a fragmentary, exploded perspective view, showing a Gibson-style guitar equipped with the roller block structure of the present invention, wherein the roller block structure is located at the bridge end of the guitar.

FIG. 8 shows an example in which the present invention is applied to the bridge end of a Gibson-style guitar. Guitar body 81 has roller block or blocks 83 attached to the body. The roller block defines six chambers, one of which, identified by reference numeral 85, is shown in an enlarged and exploded format. The chamber has essentially the same structure described with respect to FIGS. 4-6*b*. Inserted within the chamber is a shim 87 and a roller 89, the shim and roller being held in the chamber by a pair of snap springs 91. As in the embodiment described earlier, the number of shims can be varied. Preferably, the shim which contacts the roller should be a low-friction shim. In the embodiment of FIG. 8, the guitar does not have a tremolo, but the roller block structure is still used near the bridge region of the guitar.

Figure 9:
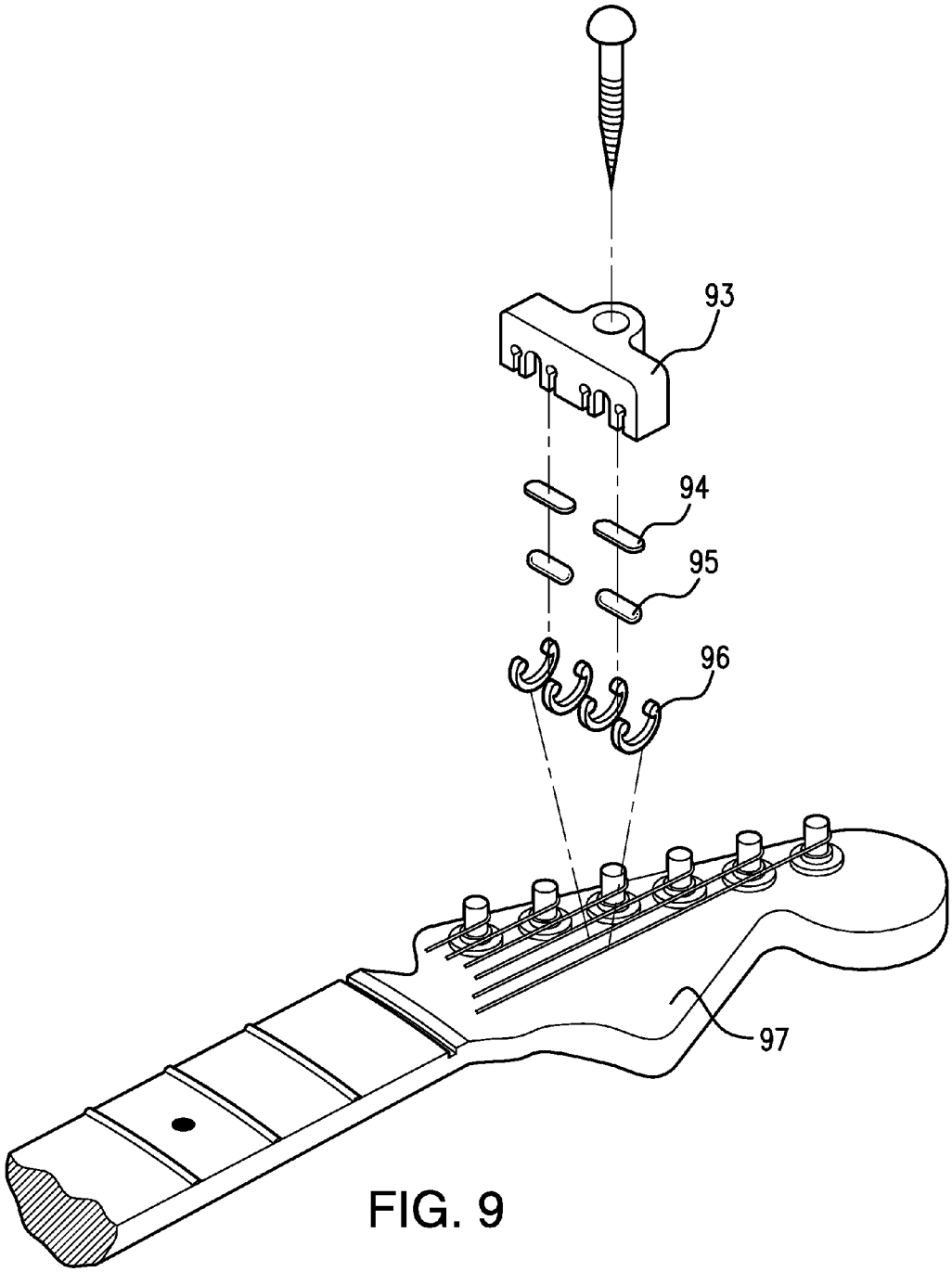
FIG. 9 provides a fragmentary, exploded perspective view showing the roller block structure of the present invention, as used with a Fender-style guitar.

FIG. 9 shows an alternative embodiment useful in Fender-style guitars, in which the roller block is positioned above the strings. A roller block 93 houses shims 94 and rollers 95, with snap springs 96 being positioned over the rollers and the roller block as before. The difference here is that the chambers of the roller block are facing the headstock 97, instead of being pointed away from it. Also, because the roller block is above the strings, instead of below them, the rollers 95 are located below the shims 94 and not above them. Also, the strings extend under the block. In all other respects, the structure works in the same way as the embodiments discussed earlier.

Figure 10:
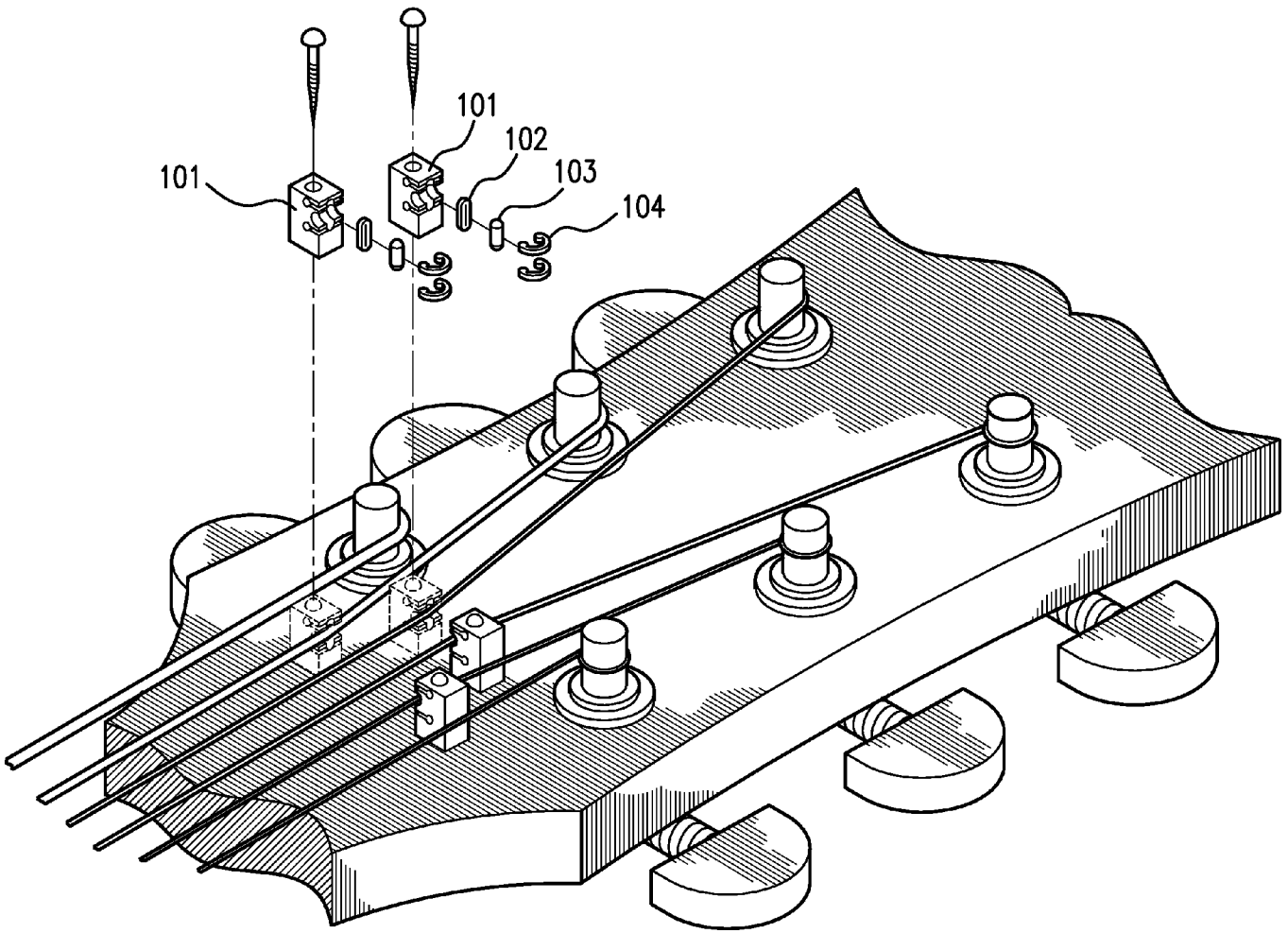
FIG. 10 provides a fragmentary, exploded perspective view of the headstock of a guitar, in which the rollers are oriented such that the strings pass alongside the rollers instead of on top of the rollers, according to the present invention.

FIG. 10 shows another embodiment wherein the rollers are oriented such that the strings pass alongside the rollers instead of on top of them. In this embodiment, there are a plurality of roller blocks 101. Each roller block contains only one chamber, in contrast to the roller blocks of the previous embodiments, wherein a single block might contain six chambers (or any other number corresponding to the number of strings). The roller blocks house shims 102 and rollers 103, and the rollers and shims are held in place by snap springs 104. This embodiment is otherwise similar to those described above.

The invention can be modified in various ways. The number of shims in each chamber can be varied, to adjust the position of the strings as required. The invention is not limited to a particular low-friction material, but can be used with materials which may not appear in the list given above. The shape of the tremolo pad will vary according to the shape of the particular tremolo device in use. These and other modifications, which will be apparent to the reader skilled in the art, should be considered within the spirit and scope of the following claims.

What is claimed is:

1. A guitar having a tremolo, the tremolo being mounted on a body of the guitar, the guitar having a tremolo pad, the tremolo pad comprising a thin sheet of low-friction material, the tremolo pad being positioned between the tremolo and the body of the guitar.

2. The guitar of claim 1, wherein the tremolo includes a sub-surface portion which extends through an opening in the body of the guitar, and wherein the tremolo pad includes a cut-out to accommodate said sub-surface portion.

3. The guitar of claim 1, wherein the tremolo is affixed to the guitar body by screws, and wherein the tremolo pad has holes which accommodate said screws.

4. The guitar of claim 1, wherein the tremolo pad has an area sufficiently large to comprise a buffer between the tremolo and the body of the guitar.

5. A roller block for guiding a string of a guitar, comprising:

a) a chamber, the chamber defining a space within which a string can be seated, and through which the string can extend, b) at least one shim disposed in the chamber, c) a roller, the roller contacting one of said at least one shim, and d) a snap spring which holds the roller and shim within the chamber.

6. The roller block of claim 5, wherein the shim which is contacted by the roller has a surface formed of a low-friction material.

7. The roller block of claim 5, wherein there are at least two shims, wherein a first shim is in contact with the roller and a second shim is not in contact with the roller, and wherein the first shim has a reduced-friction surface, and the second shim has a surface with a greater friction than that of the first shim.

8. The roller block of claim 5, wherein the block contains a plurality of chambers, each chamber having a similar internal structure.

9. The roller block of claim 5, wherein the chamber defines opposing walls, and wherein the roller has rounded ends which respectively contact said opposing walls.

10. The roller block of claim 5, the roller block being positioned at a bridge end of a guitar.

11. The roller block of claim 5, wherein the roller block is positioned in a vicinity of a nut of a guitar.

12. The roller block of claim 11, wherein the roller block is oriented such that the block is under a string of the guitar, wherein the string extends over the block.

13. The roller block of claim 11, wherein the roller block is oriented such that the block is above a string, wherein the string extends under the block.

14. The roller block of claim 11, wherein the roller block is oriented such that the block is located alongside a string, wherein the string extends along a side of the block.

15. A guitar having a tremolo, the tremolo being mounted on a body of the guitar, the guitar comprising a tremolo pad, the tremolo pad comprising a thin sheet of low-friction material, the tremolo pad being positioned between the tremolo and the body of the guitar, the guitar also including a roller block for guiding a string of the guitar, the roller block comprising:

a) a chamber, the chamber defining a space within which a string can be seated, and through which the string can extend, b) at least one shim disposed in the chamber, c) a roller, the roller contacting one of said at least one shim, and d) a snap spring which holds the roller and shim within the chamber.

16. The guitar of claim 15, wherein the roller block is positioned in a vicinity of the tremolo.

17. The guitar of claim 15, wherein the roller block is positioned in a vicinity of a nut of the guitar.

18. The guitar of claim 17, wherein the roller block is oriented such that the block is under the strings, wherein the strings extend over the block.

19. The guitar of claim 17, wherein the roller block is oriented such that the block is over the strings, wherein the strings extend under the block.

20. The guitar of claim 17, wherein the roller block is oriented such that the block is located alongside the string, wherein the string extends along a side of the block.

* * * * *